United States Patent [19]

Bernhard

[11] 4,445,549

[45] May 1, 1984

[54] ARRANGEMENT FOR A BOTTLE HANDLING MACHINE

[75] Inventor: Herbert Bernhard, Wolfsheim, Fed. Rep. of Germany

[73] Assignee: Seitz-Werke GmbH, Bad Kreuznach, Fed. Rep. of Germany

[21] Appl. No.: 346,243

[22] Filed: Feb. 5, 1982

[30] Foreign Application Priority Data

Feb., 1981 [DE] Fed. Rep. of Germany ..... 3104187

[51] Int. Cl.[3] ..... B67C 3/28

[52] U.S. Cl. ..... 141/148; 141/98; 141/192

[58] Field of Search ..... 141/94, 97, 98, 144–152, 141/135, 129, 192, 193, 250, 275, 311, 392, DIG. 2; 324/156; 174/52 R; 138/115

[56] References Cited

U.S. PATENT DOCUMENTS 2,723,790 11/1955 Spiess, Jr. et al. ..... 141/146
3,559,702 1/1968 Riesenberg ..... 141/147
3,941,157 3/1976 Barnett ..... 138/115
4,102,366 7/1978 Puskarz ..... 141/150
4,278,104 7/1981 Yajima et al. ..... 141/192

FOREIGN PATENT DOCUMENTS 2100284 7/1972 Fed. Rep. of Germany ..... 141/152

*Primary Examiner*—Stephen Marcus
*Assistant Examiner*—Kenneth S. Putman
*Attorney, Agent, or Firm*—Becker & Becker, Inc.

[57] ABSTRACT

A bottle filling machine having a lower part and an upper part rotatable relative thereto. The upper machine part includes a circular ring machine table having lift elements for the bottles to be filled, and has associated therewith filling elements connected to a liquid container, as well as a filling column having a central inflow fitting and a central rotary distributor. In the central section of the filling column is a receiving chamber for a control device, embodied as a digital computing system, for the control of the filling process; the receiving chamber is delimited by a protective cover capable of being placed in a maintenance or servicing position.

8 Claims, 4 Drawing Figures

ARRANGEMENT FOR A BOTTLE HANDLING MACHINE

The present invention relates to a bottle handling machine, especially a bottle filling machine, comprising a lower machine part, and an upper machine part rotatably mounted on the lower part and including a circular ring machine table with uniformly spaced apart, vertical lift elements for the bottles which are to be filled, and a traverse which is adjustable in height via a lift drive and is connected with a circular ring liquid container provided with filling elements associated with the lift elements; liquid for filling is supplied to the liquid container via a central inflow fitting which is connected with the traverse, and control means are associated with the liquid container for monitoring the filling process; the supply of electrical energy to the drive and control means of the bottle filling machine is effected by a central rotary distributor which is likewise associated with the traverse.

Such bottle handling machines, which generally operate fully automatically, are disclosed, for example, by German Pat. No. 21 00 284; these machines are often operated in common with devices which supplement their function, as for example so-called preliminary tables, for orderly feeding of the bottles to be filled, and capping means for closing the filled bottles. As a consequence of the number of switching operations to be carried out, and the number of physical and technical parameters which must be observed for an orderly filling of the bottles, it is expedient to replace the previous, simple analog control action, which only takes into account a few parameters, with a direct digital process control. So-called microprocessors are required herefor, and physical and technical measured values must be converted into electrical signals and fed to the microprocessor, with the control signals ascertained there being fed to the individual switching and control elements. In addition to the difficulties of signal generation and disturbance-free transmission which are encountered, the environmental conditions under which such machines operate are extremely unfavorable for the application of direct digital process control. For example, a problem is encountered if a plurality of mechanically loaded contact points are to be overcome by utilization of signals of relatively weak signal strength; also, a problem is encountered if a high relative humidity exists; and, additionally, if a plurality of liquid, pressure, and gas conduits, as well as moving conduit connections, are present, then as a consequence of bottle breakage sharp fragments or pieces there can be encountered problems therewith which especially endanger electrical conduits and the like. In particular, however, the installation of the actual process computing equipment causes difficulties, since the shortest possible, secure, conduit connections are necessary.

It is therefore an object of the present invention to further develope and improve a bottle handling machine of the aforementioned general type such that an arrangement exists secure against disturbance, i.e. operationally secure, and furthermore accommodation of the electronic components and switching elements, as well as the input and output lines, necessary for carrying out direct digital control processing, is made possible, whereby, in spite of an arrangement which is secure against disturbance, easy accessibility for calibration, maintenance, and service is also possible.

This object, and other objects and advantages of the present invention, will appear more clearly from the following specification in connection with the accompanying drawings, in which:

FIG. 1 in a partially sectional side view schematically illustrates one embodiment of a bottle filling machine with the arrangement according to the present invention for receiving electrical and electronic components;

Figure 1:
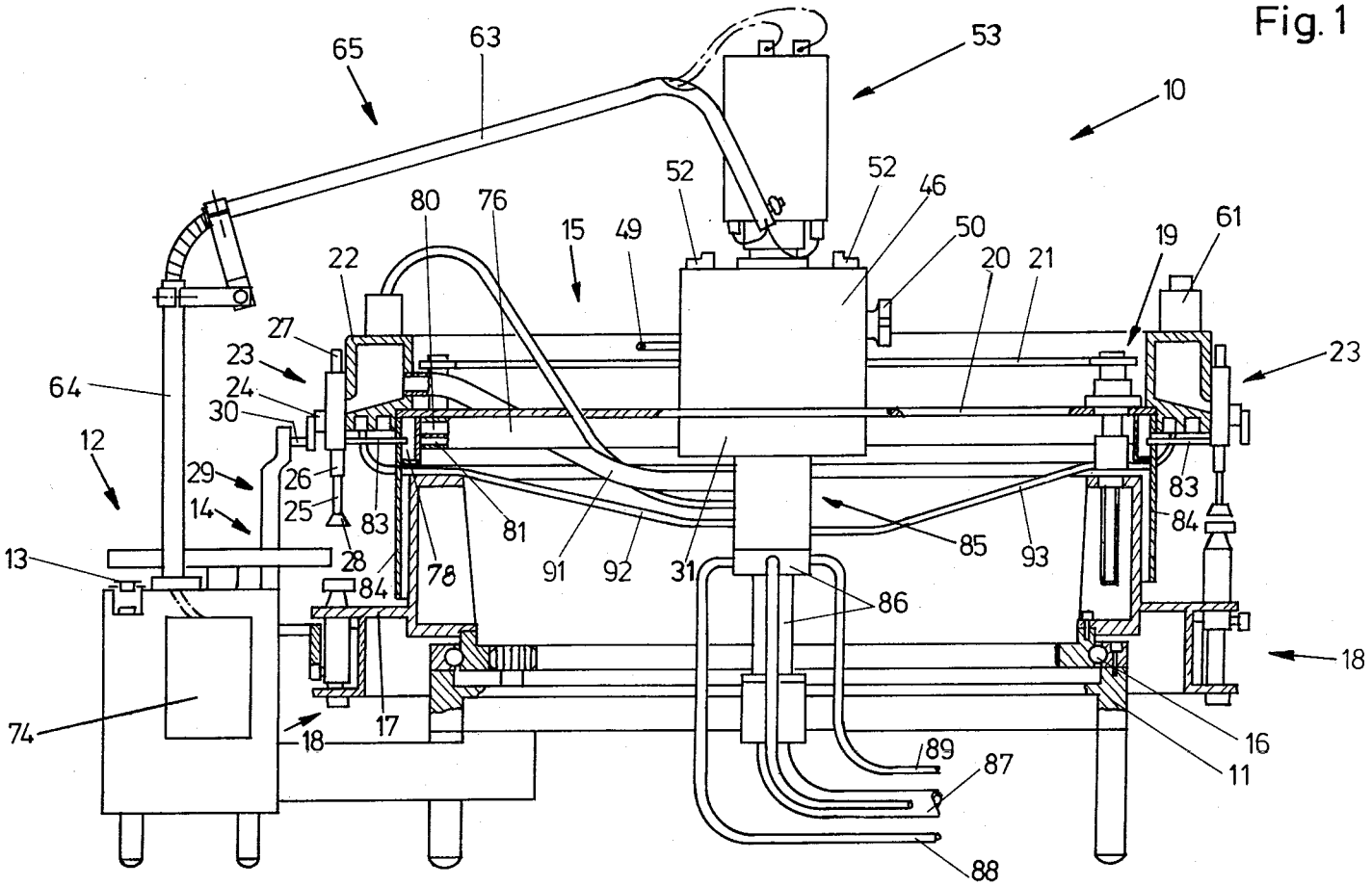

The bottle handling machine of the present invention is characterized primarily in that the traverse has a pan-shaped recess arranged concentrically relative to the axis of rotation of the upper machine part; this recess is part of a receiving chamber for a control device or switching arrangement embodied as a digital computing system with power supply and terminals associated therewith; this chamber, as an extension of the recess, is delimited by a protective shell or cover, which is journalled to move up and down, and by a plate having a central opening; this plate supports a column on which the stationary part of the rotary distributor is mounted.

According to further specific features of the present invention, the plate, which is provided with the opening, may be supported by columns which are fastened on the inner side of the recess; this recess may also support the power supply and terminals, through the intervention of spacers, as well as supporting the control device via an intermediate plate; the central inflow fitting may be arranged on the underside of the recess.

The protection cover may have a flange at each of its upper and lower ends, with the upper flange being flush with the plate and having a sealing ring on that side thereof facing the plate, while the lower flange may be seated on the traverse flush with the recess and has a sealing ring on that end face which faces the traverse; the protective cover may be kept moisture-tight in the operating position via pivotable clamping plates which cooperate with tightening screws which engage the plate; when the tightening screws are loosened, the clamping plates may serve as abutments or supports for the protective cover when the latter is raised into an assembly or servicing position.

The protective cover may have an observation window which makes it possible to see a display unit associated with the switching arrangement; the protective cover may also have handles which make it possible to raise it into the assembly position.

For the purpose of receiving air conduits, control lines, and the like, an overhang arm may be connected by means of a pivot or joint head with the rotary distributor; the overhang arm comprises an arm and a column, and is supported on a preliminary table which forms the entry and exit region of the bottle filling machine. The arm and the column of the overhang arm may be movably connected with each other via a coupling.

Cable conduits may be connected with the traverse in order to supply measured signals which are secure against disturbance by moisture; these cable conduits may be subdivided into separate cable channels by partitions and, on the one hand, open into the recess via openings and, on the other hand, are connected via inlet tubes with the respective filling elements in such a way as to be secure against fragments or broken pieces.

Further cable channels may be connected with the recess in such a way as to be sealed against moisture.

The basic concept of the present invention, to provide an easily accessible, moisture-tight closable chamber, for receiving all distribution, or switching arrangement necessary for a digital process control computing system, in or approximately in the center of the machine, now also permits transfer of the advantages of modern control techniques to the filling industry, without change of all previous machine functions and the mechanical parts necessary for this purpose. The central arrangement furthermore has the advantage of short lines or conduits, which additionally can be installed on already existing machine parts in such a way as to be secure against disturbance and damage. In particular, the functions of such a machine are not disturbed as a result of the necessary equipping thereof with electrical and electronic components, and care is taken to assure an easy accessibility.

Referring now to the drawings in detail, a so-called circulating or revolving bottle filling machine for a counter-pressure filling process is indicated generally in FIG. 1 by the reference numeral 10; this method itself is not considered here in detail since it is known, and does not belong to the teaching of the present invention.

The filling machine 10 has a base or lower part 11 which is supported stationary on the ground with height-adjustable columns. A preliminary table 12 forms a structural unit associated with the lower part 11 and likewise supported upon the ground or floor likewise with height adjustable columns. This structural unit essentially comprises the entry and exit region 14 of the machine, including the non-illustrated introducing and withdrawing stars, the bottle guide curve, as well as a feed and discharge conveyor 13 and the machine drive. A control curve or cam for the lift elements 18 is furthermore associated with the preliminary table 12.

The upper part 15 of the machine is rotatably connected with the lower machine part 11 via a ball bearing turning gear 16, and essentially comprises a circular ring-shaped machine table 17 having a vertical lift elements 18 which are uniformly spaced apart, as well as a traverse or crossbar 20 connected with the machine table 17 via several lifting gears 19. The lifting gears 19 are operatively connected by a common drive means, for example a gear ring 21. The traverse 20 supports a liquid container 22 having filling elements 23 arranged thereon; each filling element has a lift element 18 associated therewith. Each filling element 23 in essence has a pressurizing gas valve arrangement 24, a filling tube 25 with a switching contact 26, an actuating device 27 for the liquid flow valve, and a centering device 28 for the bottle mouth of the bottles to be filled. Several switching cams 30 are arranged in different planes on a raisable and lowerable control ring 29 for actuation of the pressurizing gas valve arrangement 24.

Figures 2, 3, 4:
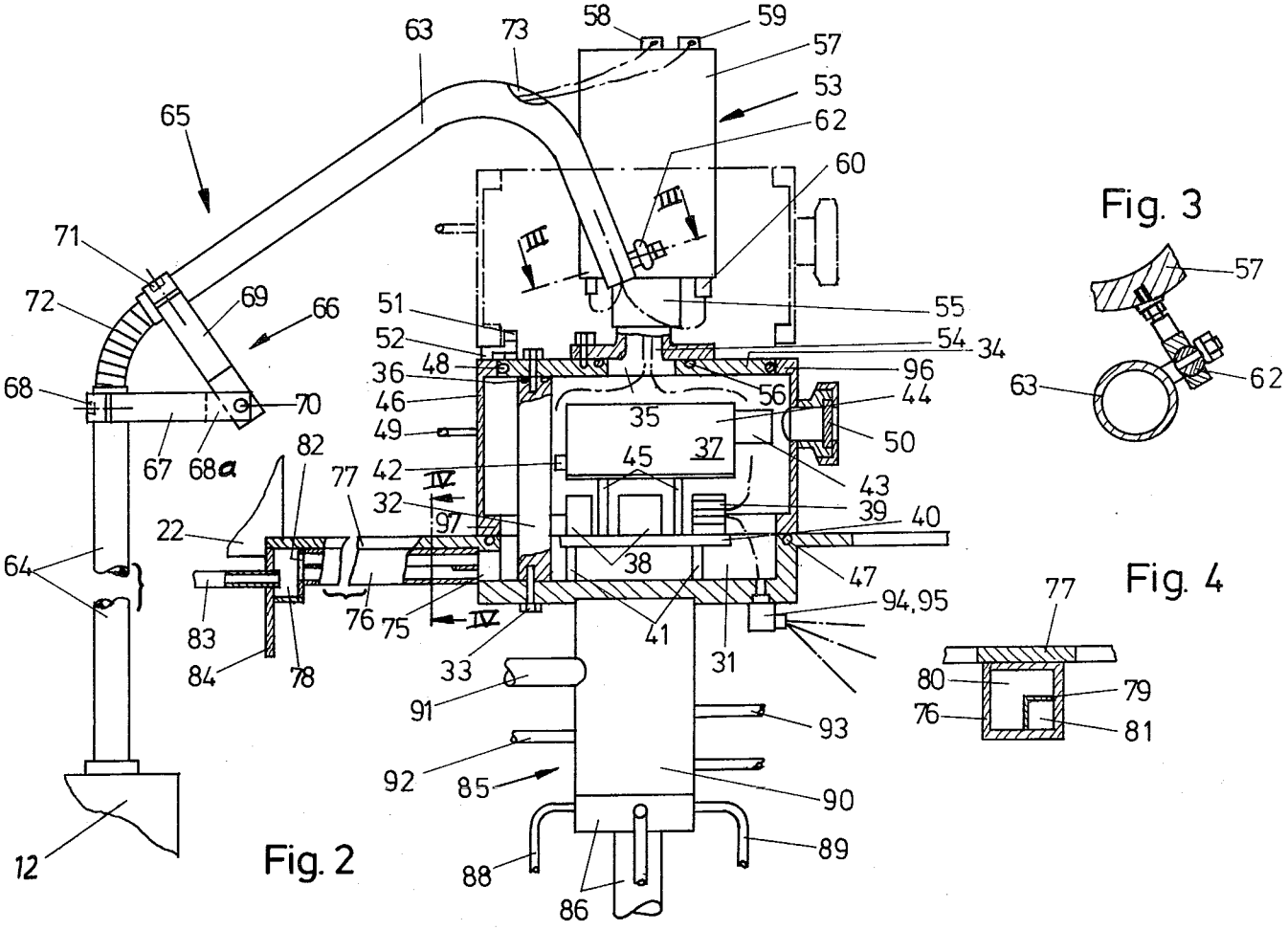
FIG. 2 is a partially sectioned view of the receiving chamber for the computing equipment.
FIG. 3 is a section taken along line III—III in FIG. 2.
FIG. 4 is a section taken along line IV—IV in FIG. 2.

The center of the traverse 20 is provided with a pan-shaped recess 31 arranged concentrically relative to the axis of rotation of the machine. As shown in FIG. 2, several columns 32 are supported on the bottom of the recess 31 and are fastened with screws 33. The columns 32 are uniformly distributed in the vicinity of the cylindrical inner wall of the recess 31, and support a plate 34 having a central opening 35. The plate 34 is secured by screws directly with the columns 32 subject to the interposition of sealing rings 36. The inner chamber, which is surrounded by the columns 32, contains a control device 37 such as a digital computing system, including the power supply 38 and connection elements, for instance in the form of terminals 39. The power supply 38, which comprises rectifiers, transformers, fuses, and the like, and the terminals 39, are fastened to an intermediate plate 40, which is connected via spacers 41 to the bottom of the recess 31. A housing 44, through the intervention of spacers 45, is fastened on the intermediate plate 40 for receiving the control device 37; the housing 44 is provided with connections 42, and a display unit or visual indicator 43, for instance digital display for indicating disturbances and detecting errors. A protective shell or cover 46, which is supported on the upper side of the traverse 20, as well as being flush with the upper side of the plate 34 and centered via the outer diameter thereof, surrounds the columns 32 and consequently the control device 37, the power supply 38, as well as the terminals 39. The upper and lower ends of the protective cover 46 are respectively provided with a flange; the upper flange 96 terminates flush with the plate 34, and on that side thereof facing the plate supports a sealing ring 48, while the lower flange 97 is seated flush with the recess 31 on the traverse 20, and on that side thereof facing the traverse supports a sealing ring 47. The protective cover 46 is sealed-off toward the traverse 20 and toward the plate 34 with the aid of the sealing rings 47, 48. The protective cover 46 has two handles 49 fastened on opposite sides thereof. Additionally, the protective cover 46 is provided with an observation window 50 opposite the display unit 43. Several clamping plates 52, which are respectively pivotable about tightening screws 51, are arranged on the plate 34 in the vicinity of the outer diameter thereof. The protective cover 46 is tightly pressed against the traverse 20 with these plates 52 by tightening the screws 51. If any maintenance or repair work has to be undertaken on the control device 37 or on the power supply 38, the clamping plates 52, after loosening the screws 51, are pivoted out of the region of the protective cover 46 over the plate 34, so that the protective cover 46, using both handles 49 thereof, can be lifted over the upper side of the plate 34. The clamping plates 52, after being lifted, are pivoted under the protective cover 46, which is lowered onto the clamping plates 52 into the position indicated by the dash-dot lines. Now the control device 37, the power supply 38, and the terminals 39 are conveniently accessible from all sides.

Reference numeral 53 designates a rotary distributor unit which is aligned relative to the axis of rotation of the filling machine. The central column 55 of the unit 53, which is provided with the distributor outlet 54, is fastened on the plate 34 and is sealed off relative to the plate 34 by means of a seal 56. The stationary part 57 of the rotary distributor 53 mounted on the column 55 is provided with inlets 58, 59,60 for the operating air of the lift elements 18, for dry air, for example for ventilating moisture-sensitive devices, such as the level control for the filling level regulator 61, and for the electrical energy for the filling level control, the height adjustment of the upper part of the machine, the control device, etc. The outer side of the part 57, near the bottom thereof, is provided with a coupling or joint head 62 (see also FIG. 3). The bent arm 63 of the overhang arm 65, which is embodied as a cable guide and is supported on the preliminary table 12 by means of its vertical column 64, is connected to the joint head 62. The arm 63 and the column 64 are interconnected by means of a flexible coupling 66. The horizontally extending support arm 67 of the coupling 66 is provided with clamping means 68 at its one end, and is thereby fastened to the upper end of the column 64. The other end of the support arm 68, facing the machine, is embodied as a fork 68*a* and is provided with a horizontal shaft 70 for receiving the pivot arm 69 of the coupling 66. The pivot arm 69 also has a clamping means 71 for receiving that end of the arm 63 associated with the coupling 66. A flexible connecting element bridges the free space between those ends of the arm 63 and column 64 connected with the coupling 66, for example a spiral hose 72 firmly inserted in the open space of the column 64 and the arm 63. An opening 73 is provided in the external radius of the curvature of the arm 63. The cable guide formed by the overhang arm 65 is guided to the control cabinet 74 of the filling machine; this cabinet 74, for example, can be fastened on the preliminary table 12.

Cable conduits 76 are respectively connected to the recess 31 via an opening 75. These conduits 76 extend under one of the arms 77 of the traverse 20, and in particular extend between the recess 31 and an annular cable channel 78 arranged laterally of the underside of the liquid container 22. A given cable conduit 76 intended for the cables of several filling elements 23 is connected with the associated arm 77, for example by welding seams, and is subdivided into channels 80, 81 (FIG. 4) by means of partition 79 welded therein; these channels 80, 81 open into an opening 82 of the cable channel 78. The channel 80 is designed for cables with which for example, the actuating devices 27 of the filling elements 23 are connected to the control devices 37, while the channel 81 is provided for shielded cables which, for example, serve for connecting the switching contacts 26, such as probes, which determine the filling level in the bottles, to the control device 37. An inlet tube 83 exists for each filling element 23 in order to introduce these cables into the cable channel 78, which distributes the cables to the cable conduit 76, in such a way that they are protected against fragments or pieces encountered during bursting or exploding of bottles. One end of this inlet tube 83 nearly extends to the vicinity of the filling element 23, and the other end of the inlet tube 83 terminates in the cable channel 78, into which it is inserted through a bore arranged in the lining 84, which is provided with a sealing element. Cable channels 94 and 95 are provided for cables guided to the filling level regulator 61 and to operate the height adjustment device of the upper machine part 15.

A further distributor 85 which is also aligned relative to the axis of rotation of the machine in a location spaced axially of the rotary distributor unit 53, is connected with the bottom wall of the recess 31 as a central inflow fitting for supplying the liquid container or vessel 22, and hence the filling elements 23, with liquid and pressurizing gas, as well as for removing the return gas resulting during the filling process. Conduits 87, 88, 89 for liquid, pressurizing gas, and return gas are connected to the stationary portion 86 of the distributor, which portion is fixed to the lower machine part 11, and connecting lines or conduits 91, 92, 93 for liquid, pressurizing gas, and return gas leading to the liquid container 22 are provided in that region 90 of the distributor which rotates with the traverse 20.

The present invention is, of course, in no way restricted to the specific disclosure of the specification and drawings, but also encompasses any modifications within the scope of the appended claims.

What I claim is:

1. A bottle filling machine, comprising:

a lower machine part;

an upper machine part rotatably mounted on said lower machine part;

a circular ring machine table connected to said upper machine part;

uniformly spaced apart, vertical lift elements for bottles to be filled, said lift elements being associated with said machine table;

a traverse connected to said machine table in such a way as to be adjustable in height relative thereto, said traverse being provided with a pan-shaped recessed portion arranged concentric to the axis of rotation of said upper machine part, said recessed portion being part of a receiving chamber for a control device, which is in the form of a digital computing system, and for the power supply and terminals associated with said control device; said receiving chamber, as an extension of said recessed portion of said traverse, being further delimited by a protective shell, which is mounted on said recessed portion in such a way as to be movable up and down, and by a plate mounted on said protective shell and having a central opening;

a column supported by said plate over said central opening thereof;

a circular ring liquid container connected to said traverse and provided with filling elements respectively associated with respective ones of said lift elements;

a central inflow fitting connected to said recessed portion of said traverse and operatively connected to said liquid container for supplying liquid for filling bottles thereto;

control means associated with said liquid container for monitoring the filling process; and a rotary distributor for supplying electrical energy to drive and control devices of said bottle filling machine, said distributor having a stationary part mounted on said column.

2. A bottle filling machine according to claim 1, which includes support columns fastened on that side of said recessed portion which faces said receiving chamber, said plate being supported by said support columns; an intermediate plate supported on that side of said recessed portion which faces said receiving chamber through the intervention of first spacers, said power supply and terminals being supported directly on said intermediate plate, and said control device being supported indirectly on said intermediate plate through the intervention of second spacers; said central inflow fitting being connected to that side of said recessed portion remote from said receiving chamber.

3. A bottle filling machine according to claim 2, in which said protective shell is open toward both ends, which are respectively provided with a flange, one of said flanges being flush with said plate which is mounted on said shell and also being provided with a sealing ring between it and said plate, while the other flange is seated on said traverse, flush with said recessed portion thereof, and is provided with a sealing ring between it and said traverse; and which includes pivotable clamping plates which cooperate with tightening screws which engage said plate which is mounted on said protective shell; said clamping plates keeping said shell moisture proof when the latter is in its operating position; said clamping plates further serving as supports for said protective shell when said tightening screws are loosened and said shell is raised into an assembly position.

4. A bottle filling machine according to claim 3, which includes a display unit associated with said control device in said receiving chamber; in which said protective shell is provided with an observation window which makes it possible to view said display unit; and in which said protective shell is provided with handles which make it possible to raise said shell into said assembly position.

5. A bottle filling machine according to claim 1, which includes a preliminary table which is associated with said lower machine part and forms the entry and exit region of said bottle filling machine; an overhang arm for receiving air conduits, control lines, and the like, said overhang arm being supported on said preliminary table, being connected to said rotary distributor by means of a joint head, and comprising an arm and a column.

6. A bottle filling machine according to claim 5, which includes a coupling which interconnects said arm and said column of said overhang arm in such a way that they are movable relative to one another.

7. A bottle filling machine according to claim 3, which includes cable conduits connected to said traverse for conveying measured signals which are secure against interference by moisture; said cable conduits being subdivided into separate cable channels by partitions; one end of each of said cable conduits being in communication with said receiving chamber via said recessed portion of said traverse, and the other end of each of said cable conduits communicating with respective filling elements via respective lead-in tubes in such a way as to be secure against fragments.

8. A bottle filling machine according to claim 7, which includes further cable channels communicating with said receiving chamber of said recessed portion of said traverse in such a way as to be moistureproof.

* * * * *